United States Patent [19]

Woodard

[11] 4,270,745

[45] Jun. 2, 1981

[54] MULTIPLE STACK ROLL-WAVE SHEET SEPARATOR APPARATUS

[75] Inventor: Harrold R. Woodard, Georgetown, Tex.

[73] Assignee: International Business Machines Corporation, Armonk, N.Y.

[21] Appl. No.: 53,647

[22] Filed: Jun. 29, 1979

[51] Int. Cl.[3] ..... B65H 3/06; B65H 3/44

[52] U.S. Cl. ..... 271/9; 271/117; 271/120

[58] Field of Search ..... 271/9, 19, 21, 37, 109, 271/113, 114, 116–118, 119, 120; 74/9

[56] References Cited

U.S. PATENT DOCUMENTS

| | | | |
|---|---|---|---|
| 1,489,149 | 4/1924 | Pelto | 74/9 |
| 3,008,709 | 11/1961 | Buslik | 271/10 |
| 3,276,770 | 10/1966 | Griswold | 271/19 |
| 3,970,299 | 7/1976 | Berger, Jr. et al. | 271/250 |
| 4,165,870 | 8/1979 | Fallon et al. | 271/250 X |

OTHER PUBLICATIONS

IBM Technical Disclosure Bulletin; vol. 20, No. 6, pp. 2117–2118, "Combing Wheel Paper Feed" Colglazier et al; 11–1977.

IBM Technical Disclosure Bulletin; vol. 20, No. 8, p. 2933 "Paper Feed Wheel", Hunt 1–1978.

IBM Technical Disclosure Bulletin; vol. 21, No. 2, p. 477 "Sheet Shingler", Fallon et al; 7–1978.

*Primary Examiner*—Robert W. Saifer

*Attorney, Agent, or Firm*—J. B. Kraft

[57] ABSTRACT

A roll-wave sheet separator is provided for simultaneously separating sheets from two stacks in opposite sheet feed directions. The separator comprises a sheet support for supporting a first and a second stack of sheets and a sheet separator mounted adjacent to the stacks comprising a rotatable shaft having a first coaxial helical peripheral thread formed along a portion of the shaft near the first stack and a second coaxial helical peripheral thread formed along another portion of the shaft near the second stack and having a direction opposite to that of the first thread. First and second followers which are rotatable about the axis of the shaft, respectively follow said first and second threads. A motor is provided for rotating the shaft in the selected one of two directions whereby the first follower is driven into engagement with the uppermost sheet in the first stack when the shaft is rotating in one of said two directions and the second follower is driven into engagement with the uppermost sheet in the second stack when the shaft is rotating in the opposite direction.

11 Claims, 4 Drawing Figures

MULTIPLE STACK ROLL-WAVE SHEET SEPARATOR APPARATUS

DESCRIPTION

BACKGROUND OF THE INVENTION

The present invention relates to apparatus for separating sheets from a stack so that the sheets may be fed to sheet processing apparatus such as printers. More particularly, the invention relates to sheet separating apparatus which operates on the "roll-wave" principle to separate sheets from a stack of sheets. This roll-wave principle of sheet separation was first described in U.S. Pat. No. 3,008,709 to W. S. Buslik as well as in an extensive number of subsequent publications including the publication, "Paper Feed Wheel", R. E. Hunt, *IBM Technical Disclosure Bulletin,* January 1978, page 2933; "Trailing Edge Paper Feeding Apparatus", R. E. Hunt, *IBM Technical Disclosure Bulletin,* October 1977, page 1678; "Combing Wheel Paper Feed", D. F. Colglazier, E. P. Kollar and F. R. Mares, *IBM Technical Disclosure Bulletin,* November 1977, page 2117; "Improved Shingler Design", E. J. Friery and B. H. Kunz, *IBM Technical Disclosure Bulletin,* December 1977, page 2579; "Sheet Shingler", J. L. Fallon, R. E. Hunt, E. P. Kollar, and J. H. Rhodes, Jr., *IBM Technical Disclosure Bulletin,* July 1978, page 477. As set forth in the basic patent and subsequent publications, the roll-wave principle involves the recognition that by urging a circular member such as a ball or roller into engagement with the surface of the uppermost sheet in a stack of paper or similar sheet material while applying only a minimum of pressure which would be necessary to form a slight deformity or depression in the several uppermost sheets beneath the circular element, then when the circular element is moved across the surface, and particularly if the circular element is free rolling, the slight indentation in the uppermost sheets will shift or roll like a wave following the moving circular element. This wave will in effect be transmitted to the edge of the stack of sheets and will result in the shingling of the uppermost sheets which were subject to the roll-wave depression.

Once the sheets are thus shingled, they are much easier to separate from the top of the stack with conventional sheet feed apparatus as described in the above art. During the period in the cycle when the shingled top sheet or sheets are being removed from the stack by the sheet feed apparatus, it is desirable that the circular member be withdrawn from engagement with the paper so that it will in no way impede the removal operations. In the prior art this is accomplished by a withdrawal expedient which lifts the circular shingling member away from the paper stack.

Among the most significant aspects of roll-wave paper shingling is the maintenance of a preselected constant pressure by the circular or roller element upon the surface of the uppermost sheet in the stack. If the pressure is too slight, there will be substantially no indentation and consequently no roll-wave to create the shingling. On the other hand, if the pressure is too great, paper buckling and damage may take place.

Copending application, Ser. No. 53,484, "Roll-Wave Sheet Separator Structure", S. P. Garrison et al., filed on the same date as the present application and having a common assignee, provides apparatus which maintains a constant pressure by the roller element upon the surface of the uppermost sheet in the stack irrespective of the thickness of the stack and also provides a simple expedient for withdrawing the roller element from engagement with the paper so that it will not interfere with sheet removal operation in paper feed apparatus.

Said copending application provides apparatus comprising means for supporting a stack of sheets and sheet separating means mounted adjacent to the stack which comprise a rotatable shaft having a helical peripheral thread coaxial with a shaft, a follower rotatable about the shaft following the helical thread to move along a shaft axis, at least one circular element supported on the follower and means for rotating the shaft in one direction to drive the follower and the supported element against the surface of the outermost sheet in the stack to thereby shingle said sheet away from said stack. The apparatus further includes means for abruptly stopping the rotation of the shaft whereby the follower together with said element move along the shaft back out of engagement with the sheet surface.

BRIEF DESCRIPTION OF THE PRESENT INVENTION

My invention involves an improvement on the apparatus of said copending application which makes the apparatus of said copending application operable for shingling sheets from at least two different stacks in opposite directions. In certain paper feed apparatus it may be necessary to feed paper from two different stacks in different directions during the operation of equipment. For example, in the input/output feeds to printers, it may be desirable to have an input stack which is shingled and fed as an input to the printer in one direction and an output stack of sheets emerging from the printer which may be temporarily accumulated in a stack before being shingled and fed elsewhere in the opposite direction through the sheet feed apparatus.

The present invention involves the recognition that with the apparatus of the copending application utilizing a rotatable shaft and helical cam means coaxial with the shaft upon which a follower moves into engagement with a member to be acted upon such as a stack of sheets when the shaft is rotated, if a second helical cam or thread means are formed upon another portion of a shaft and this thread has a direction opposite to that of the first thread, then a second follower may be mounted upon said second thread to provide apparatus capable of engaging first and second members such as stacks dependent upon the direction in which the shaft is rotated.

Applying this concept to sheet separating apparatus, the present invention provides sheet separating apparatus comprising means for supporting a first and a second stack of sheets and sheet separating means mounted adjacent to the stacks comprising a rotatable shaft having a first coaxial helical peripheral thread formed along one portion of the shaft and a second coaxial helical peripheral thread formed along another portion of the shaft and having a direction opposite to that of the first thread. In such a structure, first and second followers, respectively, operatively associated with said first and second threads may be respectively driven into selective engagement with the outermost sheet in said first and said second respective stacks dependent upon the direction of rotation of the shaft. As the followers contain the shingling rollers, rotation of the shaft in one direction will result in the rollers of the first follower being brought into engagement with the first stack to shingle paper from the first stack in a first direction, e.g., towards a printer; rotation of the shaft in the opposite direction will drive the rollers on the second follower into engagement with the second stack to shingle the sheets in the second stack so that the sheets may be shingled in the opposite direction, e.g., away from the printer.

BRIEF DESCRIPTION OF THE DRAWINGS

Referring now to the drawings, wherein a preferred embodiment of the invention is illustrated, and wherein like reference numerals are used throughout to designate like parts.

DESCRIPTION OF THE PREFERRED EMBODIMENTS

Figure 1:
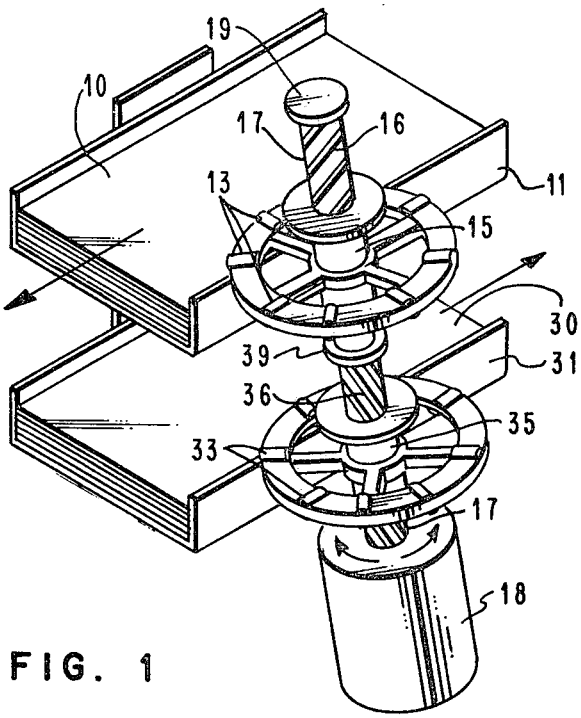
FIG. 1 is a diagrammatic isometric view of the sheet separator apparatus of the present invention.

For purposes of clarity in illustration, the apparatus in FIG. 1 is shown at a point where the shingling apparatus is at an intermediate point, i.e., not in engagement with either stack 10 in sheet receptacle 11 or stack of sheets 30 in sheet receptacle 31. In actual operation, the only time that the follower will be in the disengaged position shown in FIG. 1 will be at some intermediate point during the transition from rotation in one direction to rotation in the opposite direction. Normally during operation either the rollers 13 of follower 15 will be in engagement with stack 10 or the rollers 33 of follower 35 will be in engagement with stack 30 or both follower 15 and 35 will be in their uppermost positions when the shaft is stopped and the followers are out of engagement.

The positions of the followers during these various stages will be subsequently described with respect to FIGS. 2–4. It should be noted with respect to FIGS. 2–4 that several of the rollers 13 and 33 have been removed to more clearly show the drive apparatus.

Figure 2:
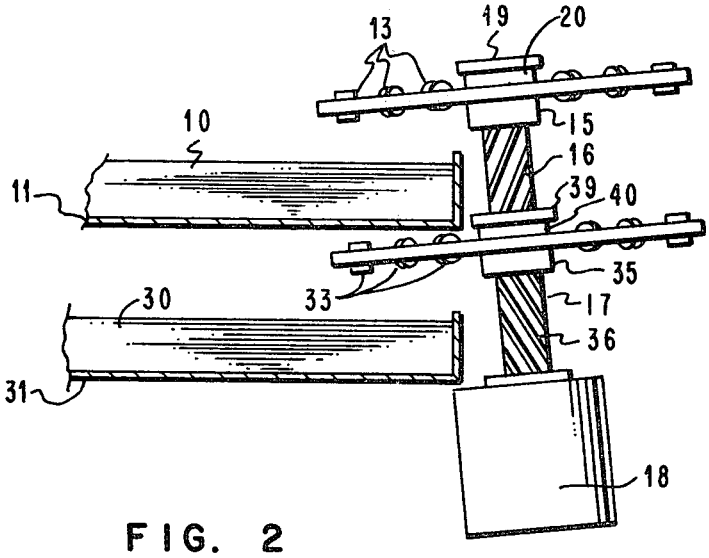
FIG. 2 is a partial diagrammatic front view of the sheet separator of the present invention facing the sheet stacks of FIG. 1 shown at a point in the apparatus operation when the shaft is not rotating and both followers are out of engagement with the respective sheet stacks.
Figure 3:
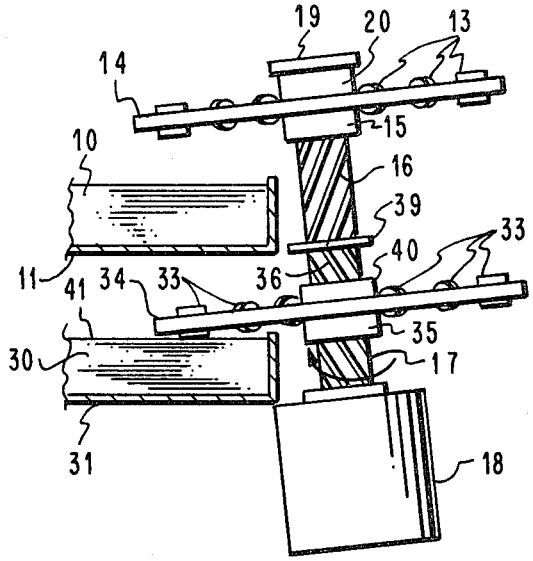
FIG. 3 is the same view as FIG. 2 of the apparatus shown at a point in the operation when the shaft is rotating in one direction and rollers on one of the followers are in engagement with the top sheet of one of the stacks.

With reference to FIGS. 1 and 2, rollers 13 and 33 are supported respectively on rings 14 and 34 of followers 15 and 35 so as to be freely rotatable within said rings. A first helical thread 16 formed along the periphery of the upper portion of shaft 17 runs in one direction while second helical thread 36 formed in the lower portion of shaft 17 runs in the opposite direction. Follower 15 has an internal thread (not shown) mating with the first helical thread 16 of the shaft while follower 35 has an internal thread (not shown) mating with helical thread 36 of the shaft. Housing 18 which is afixed to the frame of the sheet separator apparatus (not shown) supports shaft 17 in the position shown and contains the drive means which are capable of rotating shaft 17 in either the clockwise or counterclockwise direction shown by the arrows. The rollers 13 and 33, respectively, supported in rings 14 and 34 may conveniently have a structure comprising a plurality of balls arranged so as to be freely rotatable within the supporting ring as in U.S. Pat. No. 3,008,709. Preferably they have a structure like that shown in the present drawing or like that in above-mentioned publications in the *IBM Technical Disclosure Bulletin*, January 1978, p. 2933 and July 1978, p. 477, i.e., a plurality of freely rotatable rollers supported peripherally in a rotating ring structure.

With reference to FIG. 2, the initial or non-feed position is shown, i.e., the position when there is no feed from either stack. Followers 15 and 35 and their respective rollers 13 and 33 are maintained spaced from stacks 10 and 30 so that all the rollers are out of engagement with the paper stacks. Means are provided for retaining followers 15 and 35 in this position away from the stacks. Conveniently, magnetic means may be provided to magnetize plates 19 and 39 so that they respectively engage and hold up the top surfaces 20 and 40 of followers 15 and 35 respectively during the period shown in FIG. 2 when shaft 17 is not rotating.

At this point let us assume that it is necessary to feed from stack 30 in the direction shown. For example, stack 30 is to be shingled so that sheets of paper may then be removed and fed into a printer which is not shown. In order to commence this shingling operation, shaft 17 is rotated in the clockwise direction at a velocity sufficient to drive follower 35 out of magnetic engagement with plate 39 down the shaft along helical thread 36 until rollers 33 carried on rotating ring 34 successively engage top sheet 41 in stack 30, as shown in FIG. 3, to produce the roll-wave shingling effect described in the above patent and publications.

As set forth in the above-mentioned copending application, the helical drive urging follower 35 down into engagement with the paper stack is similar to the drive used in the automotive industry in the inertia gear drive for starters. In this type of a starter, a pinion or follower is shifted along an armature shaft on a quick screw thread.

Like the apparatus in said copending application, rollers 33 may be readily brought out of engagement with top sheet 41 by abruptly stopping the rotation of shaft 17. Then, the momentum which has been imparted to follower 35 will be dissipated by rotating the follower back up shaft 17 along helical thread 36 until the top of the follower is magnetically reengaged with plate 39 to maintain rollers 33 out of engagement with stack 30.

At this point, during the period when rollers 33 are out of engagement with stack 30, one or more of the uppermost shingled sheets may be removed by any standard paper handling expedient, after which the same clockwise rotation of shaft 17 may be resumed to bring rollers 33 back down into engagement with the uppermost sheet remaining in stack 30 where it is desired to continue to feed sheets from stack 30 as described. Because of the nature of the helical drive mechanism rollers 33 will exert the same force on paper stack 30 irrespective of the diminishing thickness of stack 30 as sheets are shingled and removed. This is the case because the pressure exerted by rollers 33 is determined primarily by a combination of factors including the rotational velocity of the shaft, the mass of the follower, the angle of the helix and the drag of rollers 33, but in no way by the thickness of the stack of paper 30.

Figure 4:
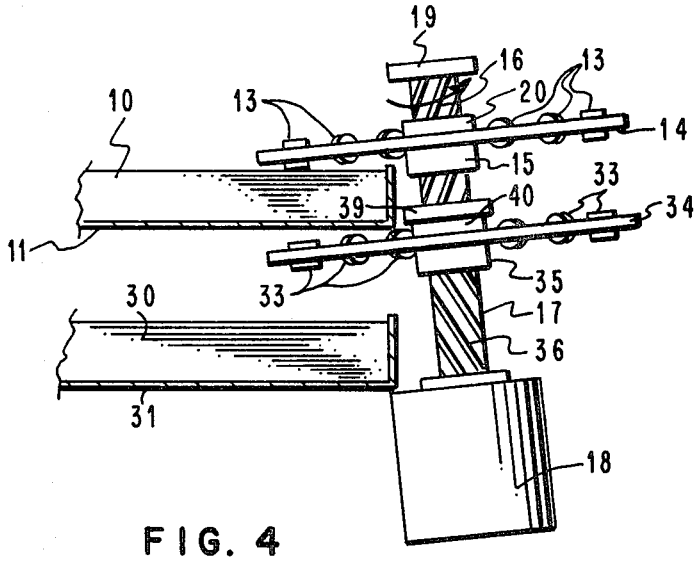
FIG. 4 is the same view shown in FIG. 2 at a point in the operation of the apparatus when the shaft is rotating in the opposite direction and the rollers on the other follower are in engagement with the top sheet of the other stack.

When it is desired to stop feeding from stack 30 and to commence feeding from stack 10, for example, when feed from a printer has produced stack 10 and the paper from stack 10 is to be removed and fed elsewhere by paper feed apparatus, the counterclockwise rotation of shaft 17 is stopped as previously described, and shaft 17 is now rotated in the counterclockwise direction as shown in FIG. 4. The rotation is at a velocity sufficient to drive follower 15 out of magnetic engagement with plate 19 down the shaft along helical thread 16 until rollers 13 carried on rotating ring 14 successively engage the top sheet 21 in stack 10 to produce the roll-wave shingling effect. When desired, rollers 13 may be readily brought out of engagement with top sheet 21 as previously described by abruptly stopping the rotation of shaft 17. Then, the momentum which has been imparted to follower 15 will be dissipated by rotating the follower back up shaft 17 along helical thread 16 until the top of the follower is magnetically reengaged with plate 19 to maintain rollers 13 out of engagement with stack 10.

During the period when rollers 13 are out of engagement with stack 10, one or more of the uppermost shingled sheets may be removed by any standard paper handling expedient, after which the rotation of shaft 17 may be resumed to bring rollers 13 back down into engagement with the uppermost sheet in the remaining stack. Because of the nature of the helical drive mechanism, rollers 13 will exert the same force on paper stack 10 irrespective of the diminishing thickness of stack 10 as sheets are shingled and removed for the reasons set forth hereinabove.

From the foregoing it should be obvious that the principles of the present invention have potential applications beyond the sheet shingling field. Through the use of a rotatable shaft having first and second opposite helical cam means coaxial with the shaft formed over respective peripheral portions of the rotatable shaft and first and second followers respectively for these helical cam means, then by selective rotation of the shaft in one direction, one of the followers may be driven into operative engagement with a first member or workpiece, and upon the rotation of the shaft in the opposite direction, the other of said followers may be driven into operative engagement with a second member or workpiece.

While the invention has been particularly shown and described with reference to a particular embodiment, it will be understood by those skilled in the art that various changes in form and detail may be made without departing from the spirit and scope of the invention.

What is claimed is:

1. Drive apparatus comprising a rotatable shaft, first helical cam means coaxial with said shaft formed along a portion of said shaft, second helical cam means coaxial with said shaft formed along another portion of said shaft and having a direction opposite to that of said first cam means, a first follower rotatable about the axis of said shaft following said first helical cam means, and a second follower rotatable about said shaft following said second helical cam means, whereby upon rotation of the shaft in one direction, one of said followers is driven into operative engagement with a first member and upon rotation of the shaft in the opposite direction, the other of said followers is driven into operative engagement with a second member.

2. Sheet separating apparatus comprising:

means for supporting a first and a second stack of sheets, sheet separating means mounted adjacent to said stacks comprising:

a rotatable shaft, a first helical peripheral thread coaxial with said shaft formed along a portion of said shaft proximate said first stack, a second helical peripheral thread coaxial with said shaft formed along another portion of said shaft proximate said second stack and having a direction opposite to that of said first thread, a first follower rotatable about the axis of said shaft following said first thread, a second follower rotatable about the axis of shaft following said second thread, and means for rotating the shaft in a selected one of two directions, whereby said first follower is driven into engagement with an outermost sheet in said first stack when said shaft is rotating in a selected one of said two directions and the second follower is driven into engagement with an outermost sheet in said second stack when the shaft is rotating in a selected direction.

3. The sheet separating apparatus of claim 2 wherein said first follower is driven into said engagement when the shaft is rotating in one direction, and said second follower is driven into said engagement when the shaft is rotating in the opposite direction.

4. The sheet separating apparatus of claim 3 wherein each of said followers includes a circular element supported thereon which contacts the surface of an engaged outer sheet to shingle said sheet from its respective stack.

5. The sheet separating apparatus of claim 4 wherein said circular elements are free rolling.

6. The sheet separating apparatus of claim 5 further including means for abruptly stopping the rotation of the shaft whereby the follower in engagement moves along said shaft back out of engagement with said outermost sheet.

7. The sheet separating apparatus of claim 5 wherein a plurality of said free rolling circular elements are supported on each follower.

8. The sheet separating apparatus of claim 7 further including means for maintaining said followers and the supported circular elements spaced from said outermost sheets in said stacks when said shaft is not rotating, and wherein the drive force of the shaft when rotated upon the follower being driven by said rotation is sufficient to overcome the force exerted by said maintaining means.

9. The sheet separating apparatus of claim 8 wherein said maintaining means are magnetic.

10. The sheet separating apparatus of claim 7 wherein said circular elements rotate about said shaft and said shingling is in a direction tangential to the path of said rotation, whereby the sheets in the first stack are shingled in a direction opposite to sheets in second stack.

11. The sheet separating apparatus of claim 7 or claim 10 further including means for removing said shingled uppermost sheets whereupon said follower and circular elements are driven against the surface of said next uppermost sheet.

* * * * *